US010689904B2

(12) United States Patent
Huang

(10) Patent No.: US 10,689,904 B2
(45) Date of Patent: Jun. 23, 2020

(54) ADJUSTING MEANS FOR CURTAIN CORD AND RETRACTABLE CURTAIN

(71) Applicant: Suzhou Hongren Window Decorations Co., Ltd., Taicang, Jiangsu (CN)

(72) Inventor: Jiehren Huang, Taicang (CN)

(73) Assignee: Suzhou Hongren Window Decorations Co., Ltd., Taicang, Jiangsu (CN)

( * ) Notice: Subject to any disclaimer, the term of this patent is extended or adjusted under 35 U.S.C. 154(b) by 166 days.

(21) Appl. No.: 15/751,834

(22) PCT Filed: Sep. 21, 2016

(86) PCT No.: PCT/CN2016/099512

§ 371 (c)(1),
(2) Date: Feb. 9, 2018

(87) PCT Pub. No.: WO2018/018728

PCT Pub. Date: Feb. 1, 2018

(65) Prior Publication Data

US 2018/0230745 A1 Aug. 16, 2018

(30) Foreign Application Priority Data

Jul. 25, 2016 (CN) ..... 2016 1 0585457

(51) Int. Cl.
*E06B 9/38* (2006.01)
*E06B 9/382* (2006.01)
(Continued)

(52) U.S. Cl.
CPC ..... *E06B 9/38* (2013.01); *E06B 9/262* (2013.01); *E06B 9/324* (2013.01); *E06B 9/326* (2013.01);
(Continued)

(58) Field of Classification Search
CPC . E06B 9/326; E06B 9/38; E06B 9/382; E06B 9/388; E06B 2009/402
(Continued)

(56) References Cited

U.S. PATENT DOCUMENTS 2,486,492 A * 11/1949 Redman ..... E06B 9/388 160/173 R
2,546,534 A * 3/1951 Znidarsic ..... E06B 9/388 160/173 R
(Continued)

FOREIGN PATENT DOCUMENTS

CN 1828002 9/2006
CN 2865497 2/2007
(Continued)

OTHER PUBLICATIONS

International Search Report for Application No. PCT/CN2016/099512, dated Mar. 31, 2017 in 8 pages.

*Primary Examiner* — Kyle R Grabowski
(74) *Attorney, Agent, or Firm* — Knobbe, Martens, Olson & Bear, LLP

(57) ABSTRACT

The present disclosure provides an adjusting device for a curtain cord and a retractable curtain. The adjusting device for a curtain cord comprises a mounting base for fixedly connecting to the lower end of the curtain body, the mounting base is provided with a first threading hole for the cord to pass through, the mounting base is provided with a mounting groove thereon, the first threading hole is provided on the groove wall of the mounting base, and the adjusting device further comprises a stopper for winding and fixing the cord, a winding hole is provided throughout in the middle of the stopper for the cord to pass through, the stopper is detachably jammed within the mounting groove, and a gap for accommodating the cord wound on the outer
(Continued)

surface of the stopper is located between the groove wall of the mounting groove and the stopper.

21 Claims, 3 Drawing Sheets

(51) Int. Cl.
*E06B 9/326* (2006.01)
*E06B 9/388* (2006.01)
*E06B 9/262* (2006.01)
*E06B 9/324* (2006.01)

(52) U.S. Cl.
CPC ..... *E06B 9/382* (2013.01); *E06B 9/388* (2013.01); *E06B 2009/2622* (2013.01)

(58) Field of Classification Search
USPC ..... 160/263
See application file for complete search history.

(56) References Cited

U.S. PATENT DOCUMENTS

| | | | | |
|---|---|---|---|---|
| 2,560,858 | A * | 7/1951 | Grogan | E06B 9/384 160/178.1 R |
| 5,328,113 | A | 7/1994 | de Chevron Villette et al. | |
| 7,255,149 | B2 * | 8/2007 | Rossato | E06B 9/26 160/84.04 |
| 9,119,496 | B2 * | 9/2015 | Chang | A47H 3/04 |
| 9,206,639 | B2 * | 12/2015 | Chen | E06B 9/324 |
| 10,119,329 | B2 * | 11/2018 | Anderson | E06B 9/304 |
| 2004/0144500 | A1 | 7/2004 | Nien | |
| 2006/0144527 | A1 | 7/2006 | Toti | |
| 2007/0029051 | A1 | 2/2007 | Nien et al. | |
| 2007/0261798 | A1 | 11/2007 | Hung et al. | |
| 2014/0374034 | A1 * | 12/2014 | Corey | E06B 9/262 160/170 |
| 2015/0240558 | A1 * | 8/2015 | Vrooman | E06B 9/367 160/168.1 R |
| 2017/0284156 | A1 * | 10/2017 | Hsu | E06B 9/388 |

FOREIGN PATENT DOCUMENTS

| | | |
|---|---|---|
| CN | 200948043 | 9/2007 |
| CN | 200996260 | 12/2007 |
| CN | 101173593 | 5/2008 |
| CN | 201076336 | 6/2008 |
| CN | 201771402 | 3/2011 |
| CN | 202031462 | 11/2011 |
| CN | 202706868 | 1/2013 |
| CN | 203978234 | 12/2014 |
| CN | 104847244 | 8/2015 |
| CN | 204743671 | 11/2015 |
| CN | 205000874 | 1/2016 |
| CN | 105525853 | 4/2016 |
| CN | 205153964 | 4/2016 |
| CN | 205162690 | 4/2016 |
| CN | 106050108 | 10/2016 |
| CN | 106050110 | 10/2016 |
| CN | 106089002 | 11/2016 |
| CN | 205805377 | 12/2016 |
| CN | 205876133 | 1/2017 |
| CN | 205876134 | 1/2017 |
| CN | 205876135 | 1/2017 |
| EP | 1748144 | 1/2007 |
| JP | H0451284 | 4/1992 |
| JP | 2006070448 | 3/2006 |
| JP | 2015202130 | 11/2015 |
| TW | M255316 | 1/2005 |
| WO | WO 2014169172 | 10/2014 |

* cited by examiner

ADJUSTING MEANS FOR CURTAIN CORD AND RETRACTABLE CURTAIN

TECHNICAL FIELD OF THE INVENTION

The present disclosure relates to the curtain field, and in particular to an adjusting device for a curtain cord and a retractable curtain.

BACKGROUND OF THE INVENTION

The existing retractable curtains such as Roman curtains, generally achieve retracting via cords located at least two sides of the curtain body. The upper end of the cord is tied to the winding shaft of the curtain, the winding and unwinding of the cord is controlled by a retractor, and the lower end of the cord is tied to the bottom of the curtain. Through visual inspection, the length of the cord (the length herein specifically refers to the length of the cord capable of passing through the curtain body) is adjusted by adjusting the connection position between the lower end of the cord and the curtain to cause the lengths of respective cords are the same, or otherwise different lengths will result in varying height of the curtain and cause the unbalance of the curtain. Moreover, in actual installation and use, the length of the cord may required to be adjusted according to the different weight of the curtain. Thus, a curtain capable of adjusting the length of the cord conveniently is desirable.

SUMMARY OF THE INVENTION

To solve the above mentioned problems, the present disclosure provides an adjusting device for a curtain cord and a retractable curtain.

To achieve the above mentioned purpose, the technical scheme employed by the present disclosure is:

An adjusting device for a curtain cord, comprises a mounting base for fixedly connecting to the lower end of a curtain body, the mounting base is provided with a first threading hole for the cord to pass through, the mounting base is provided with a mounting groove thereon, and the first threading hole is provided on a groove wall of the mounting base; the adjusting device further comprises a stopper for winding and fixing the cord, the stopper is detachably jammed within the mounting groove, and a gap for accommodating the cord wound on an outer surface of the stopper is located between the groove wall of the mounting groove and the stopper.

In one or more embodiments, a winding hole is provided throughout in the middle of the stopper for the cord to pass through, the outer surface of the stopper comprises an inner surface and an outer surface which are opposite, and a side surface between the inner surface and the outer surface, the inner surface is located at an end of the stopper near a bottom wall of the mounting groove, and the center line of the winding hole and the center line of the mounting groove are parallel to each other or coincide with each other.

In one or more embodiments, the side surface extends aslant gradually away from the center line of the threading hole from the inner surface to the outer surface.

In one or more embodiments, the outer surface is provided with one or more line slots running through the outer surface from the hole wall of the winding hole to the side surface.

In one or more embodiments, the hole wall of the winding hole is provided with one or more line slots running through the hole wall from the inner surface to the outer surface.

In one or more embodiments, the outer surface is provided with one or more line slots running through the outer surface from the hole wall of the winding hole to the side surface, the hole wall of the winding hole is provided with one or more line slots running through the hole wall from the inner surface to the outer surface, and the line slots on the hole wall of the winding hole correspond to the line slots on the outer surface, and are connected with corresponding line slots on the outer surface.

In one or more embodiments, the first threading hole is disposed right opposite to the winding hole, and the center line of the first threading hole coincides with the center line of the mounting groove.

In one or more embodiments, the mounting base comprises a sheet-shaped main body and a circle of protruding edges extending outwards from a lower end of the main body, the protruding edges and the main body between the protruding edges form the mounting groove, and the main body is provided with the first threading hole and a second threading hole located right above the first threading hole.

In one or more embodiments, the mounting base further comprises a turnup edge extending outwards from an upper end of the main body, and the turnup edge is provided with a third threading hole thereon located right above the first threading hole and the second threading hole.

Another technical scheme employed by the present disclosure is:

A retractable curtain comprises said adjusting device for a curtain cord.

Above all, due to the use of the above mentioned technical schemes, the present disclosure has the following advantages over the prior art: By winding the lower end of the cord on the stopper, and jamming the stopper wound by the cord within the mounting groove, the lower end of the cord may be fixed; by taking out the stopper from the mounting groove, the winding position of the cord may be adjusted, and thus the length of the cord passing through the curtain body may be adjusted; the length of the cord of the retractable curtain may be adjusted conveniently.

In the above drawings,

100—curtain body; 200—cord; 300—retractor; 400—adjusting device;

1—mounting base; 10—mounting groove; 11—main body; 110—second threading hole; 111—first threading hole; 12—protruding edge; 13—turnup edge; 130—third threading hole;

2—stopper; 20—winding hole; 201—hole wall; 202—line slot; 21—inner surface; 22—outer surface; 220—line slot; 23—side surface.

DETAILED DESCRIPTION OF EXEMPLARY EMBODIMENTS

In the following, the preferable embodiments of the present invention are explained in detail combining with the accompanying drawings so that the advantages and features of the present invention can be easily understood by the skilled persons in the art.

Figure 1:
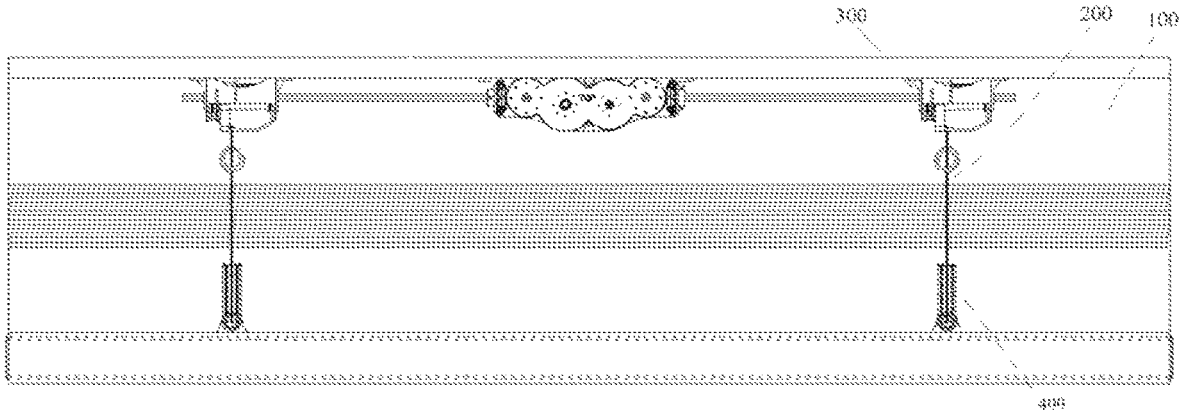
FIG. 1 is a schematic front view of a curtain of the present invention.
Figure 2:
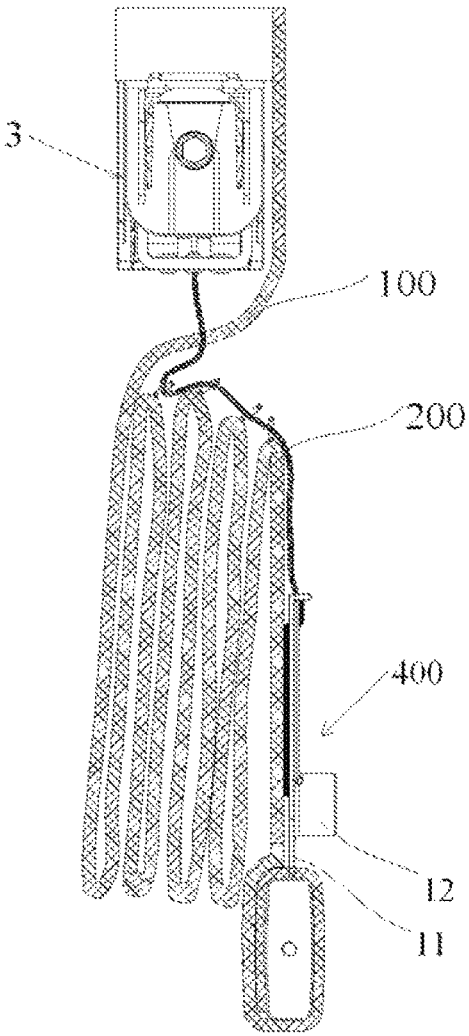
FIG. 2 is a schematic side view of the curtain of FIG. 1.
Figure 3:
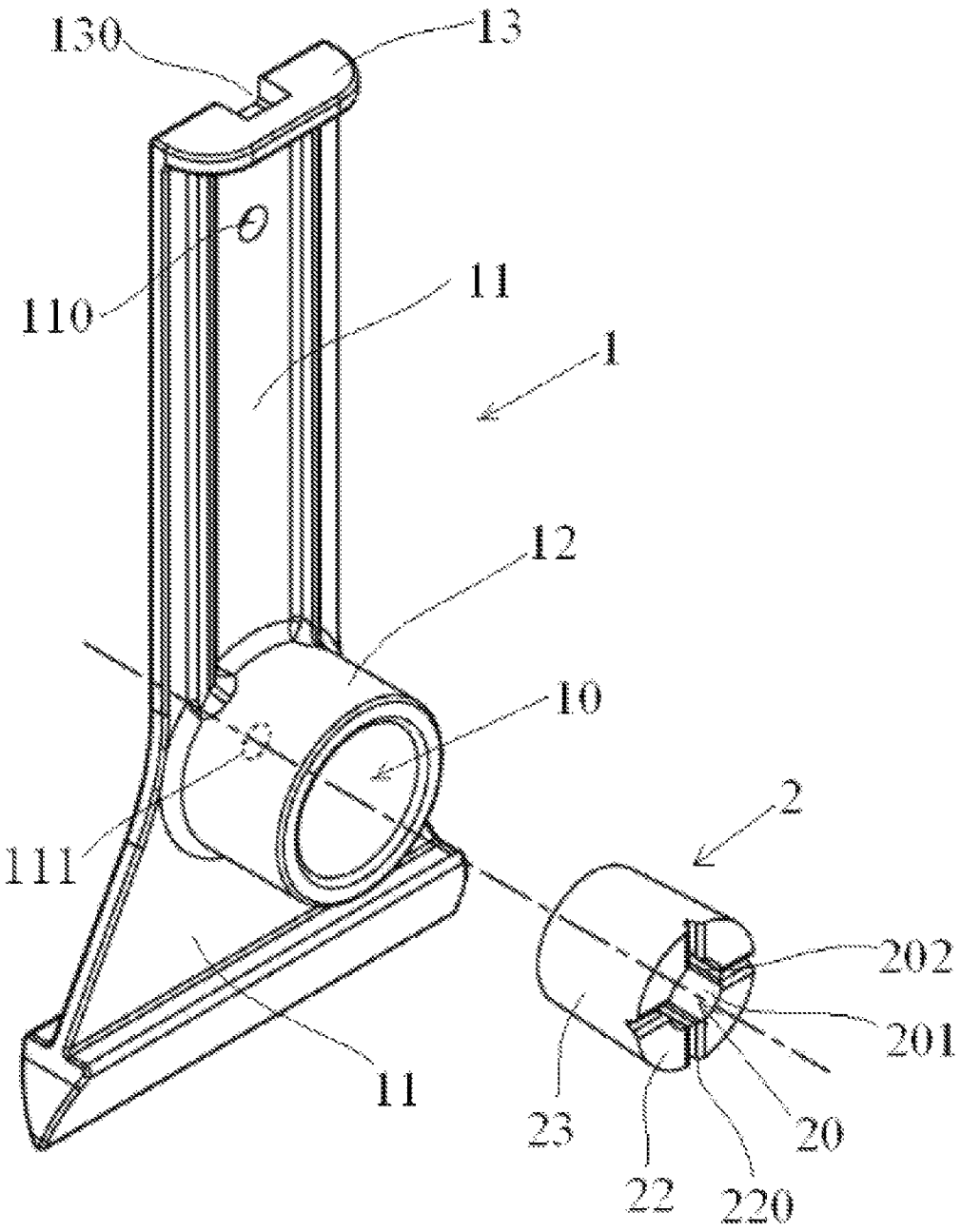
FIG. 3 is a schematic exploded diagram of an adjusting device of the present invention.
Figure 4:
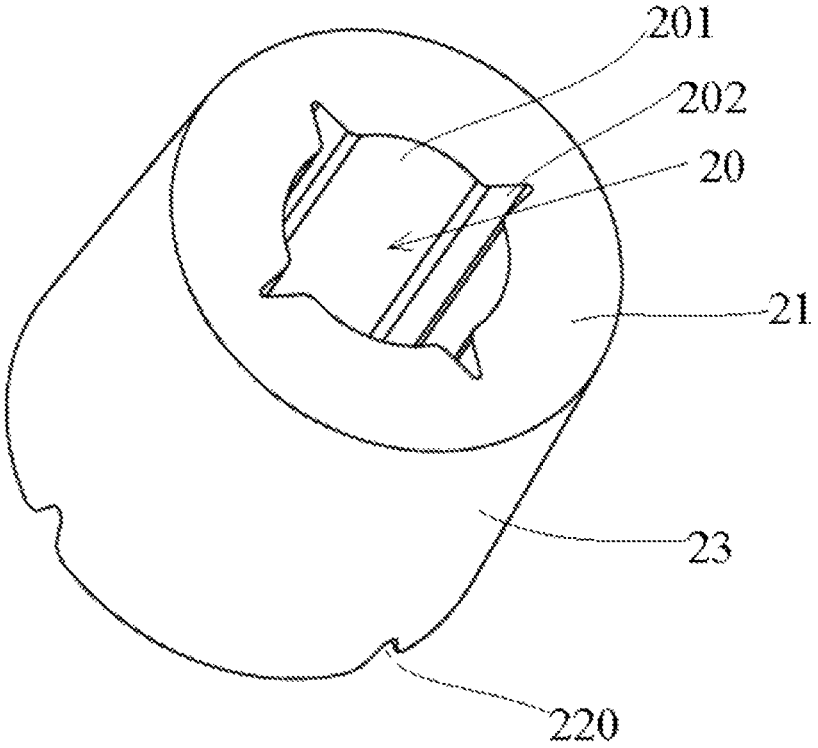
FIG. 4 is a schematic structure diagram of a stopper of the present invention.
Figure 5:
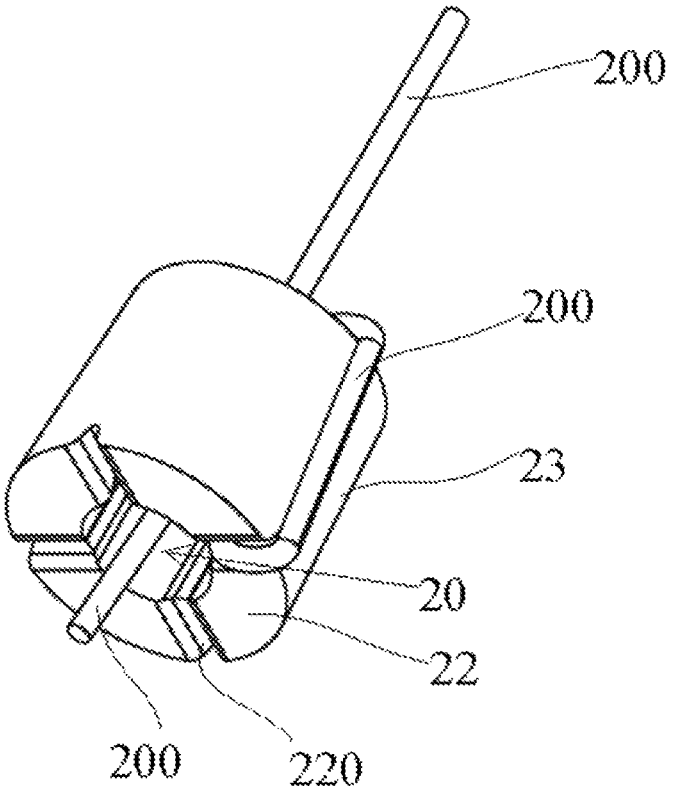
FIG. 5 is a schematic diagram of the stopper winding by the cord of the present invention.

FIGS. 1-2 show a retractable curtain of the present invention, and in particular a retractable Roman curtain. Referring to FIGS. 1-2, the retractable curtain comprises a curtain body 100, a cord 200 for retracting the curtain body 100, a retractor 300 for retracting the curtain cord 200, and an adjusting device 400 for adjusting the length of the cord 200 passing through the curtain body 100. The cord 200 passes through the curtain body 100, and the lower end of the cord 200 is fixedly connected with the lower end of the curtain body 100 via the adjusting device 400, the upper end thereof is fixedly connected with the retractor 300 to achieve retracting.

Referring to FIGS. 1-5, the adjusting device 400 for a curtain cord, comprises a mounting base 1 for fixedly connecting to the lower end of a curtain body, the mounting base 1 is provided with a first threading hole 111 for the cord 200 to pass through, the mounting base 1 is provided with a mounting groove 10 thereon, and the first threading hole 111 is provided on a groove wall of the mounting base 1. The adjusting device 400 further comprises a stopper 2 for winding and fixing the cord 200, a winding hole 20 is provided throughout in the middle of the stopper 2 for the cord 200 to pass through, the stopper 2 is detachably jammed within the mounting groove 10, and a gap for accommodating the cord 200 wound on the outer surface of the stopper 2 is located between the groove wall of the mounting groove 10 and the stopper 2.

Specifically in the present embodiment, the mounting base 1 comprises a sheet-shaped main body 11, a circle of protruding edges 12 extending outwards from a lower end of the main body 11, and a turnup edge 13 bending and extending outwards from an upper end of the main body 11, and the main body 11, the protruding edges 12 and the turnup edge 13 are formed integrally. The lower end of the main body 11 is fixedly connected with the lower end of the curtain body 100. The protruding edges 12 and the main body 11 between the protruding edges 12 form the mounting groove 10, the inner wall of the protruding edges 12 is the side wall of the mounting groove 10, and the surface of the main body 11 between the protruding edges 12 is the groove bottom of the mounting groove 10. The main body 11 is provided with the first threading hole 111 and a second threading hole 110 from the bottom up successively, and the first threading hole 111 is provided corresponding to the mounting groove 10, that is, the first threading hole 111 is provided on the groove bottom of the mounting groove 10. The second threading hole 110 is located right above the first threading hole 111, and the center lines of both are parallel to each other. The turnup edge 13 is provided with a third threading hole 130 thereon, the third threading hole 130 is located right above the second threading hole 110 and the first threading hole 111, and the three threading holes are arranged linearly. The cord 200 passes into the mounting groove 10 after passing through the third threading hole 130, the second threading hole 110 and the first threading hole 111 from the bottom up successively.

The stopper 2 is substantially hollow circular truncated cone shaped. The outer surface of the stopper 2 comprises an inner surface 21 and an outer surface 22 which are opposite, and a side surface 23 between the inner surface 21 and the outer surface 22, the inner surface of the stopper 2 is formed by the hole wall 201 of the said winding hole 20, the winding hole 20 runs through the stopper 2 from the inner surface 21 to the outer surface 22, the center line of the winding hole 20 substantially coincides with the center line of the stopper 2, the center line of the winding hole 20 is parallel to or coincides with the center line of the mounting groove 10 when the stopper 2 is jammed within the mounting groove 10, and the cord 200 is at least wound on the outer and inner surfaces of the stopper 2 for one turn. The inner surface 21 is located at an end of the stopper 2 near a bottom wall of the mounting groove 10.

The side surface 23 extends aslant in manner of gradually away from the center line of the first winding hole from the inner surface 21 to the outer surface 22, that is, the side surface 23 of the stopper 2 is a slant surface, which is convenient for jamming the stopper 2 into the mounting groove 10 or detaching the stopper 2 from the mounting groove 10.

The hole wall 201 of the winding hole20 is provided with four evenly spaced line slots 202 running through the hole wall 201 from the inner surface 21 to the outer surface 22, the outer surface 22 is correspondingly provided with four line slots 220 running through the outer surface 22 from the hole wall 201 of the winding hole 20 to the side surface 23, and the respective line slots 202 on the hole wall 201 of the winding hole 20 are connected with corresponding line slots 220 on the outer surface 22. The cord 200 passes into the winding hole 20 after passing through the first threading hole 111, winds into the corresponding line slot 220 along one of the line slots 202 on the hole wall 201 of the winding hole 20 and then back into the winding hole 20 from the side surface 23 and the inner surface 21 of the stopper 2, and then passes through the winding hole 20, or repeats the above steps from another line slot 202 on the hole wall 201 of the winding hole 20.

When it is required to adjust the length of the cord 200, the stopper 2 is pulled out from the mounting groove 10, and the winding position is adjusted until the desired passing length of the cord 200 is achieved, and due to that the mounting groove 10 limits the positions of the stopper 2 and the cord 200, the stopper 2 wound by the cord 200 is jammed into the mounting groove 10, such that the lower end of the cord 200 is fixed, and the cord 200 keeps the set length.

The embodiments described above are only for illustrating the technical concepts and features of the present invention, are preferred embodiments, and are intended to make those skilled in the art being able to understand the present invention and thereby implement it, and should not be concluded to limit the protective scope of this invention. Any equivalent variations or modifications according to the present invention should be covered by the protective scope of the present invention.

What is claimed is:

1. An adjusting device for a curtain cord, comprising: a mounting base for fixedly connecting to the lower end of a curtain body, the mounting base being provided with a first threading hole for the cord to pass through, wherein the mounting base is provided with a mounting groove thereon, and the first threading hole is provided in a groove wall of the mounting base;

the adjusting device further comprises a stopper for winding and fixing the cord, the stopper is detachably jammed within the mounting groove, and a gap for accommodating the cord wound on an outer surface of the stopper is located between the groove wall of the mounting groove and the stopper, a winding hole is provided throughout in the middle of the stopper for the cord to pass through, the outer surface of the stopper comprises an inner surface and an outer surface which are opposite, and a side surface between the inner surface and the outer surface, the inner surface is located at an end of the stopper near a bottom wall of the mounting groove, and the center line of the winding hole and the center line of the mounting groove are parallel to each other or coincide with each other, and the side surface extends aslant gradually away from the center line of the first threading hole from the inner surface to the outer surface.

2. The adjusting device for a curtain cord according to claim 1, wherein the outer surface is provided with one or more line slots running through the outer surface from a hole wall of the winding hole to the side surface.

3. The adjusting device for a curtain cord according to claim 1, wherein a hole wall of the winding hole is provided with one or more line slots running through the hole wall from the inner surface to the outer surface.

4. The adjusting device for a curtain cord according to claim 1, wherein the outer surface is provided with one or more line slots running through the outer surface from a hole wall of the winding hole to the side surface, the hole wall of the winding hole is provided with one or more line slots running through the hole wall from the inner surface to the outer surface, and the line slots on the hole wall of the winding hole correspond to the line slots on the outer surface, and are connected with corresponding line slots on the outer surface.

5. The adjusting device for a curtain cord according to claim 1, wherein the first threading hole is disposed right opposite to the winding hole, and the center line of the first threading hole coincides with the center line of the mounting groove.

6. The adjusting device for a curtain cord according to claim 1, wherein the mounting base comprises a sheet-shaped main body and a circle of protruding edges extending outwards from a lower end of the main body, the protruding edges and the main body between the protruding edges form the mounting groove, and the main body is provided with the first threading hole and a second threading hole located right above the first threading hole.

7. The adjusting device for a curtain cord according to claim 6, wherein the mounting base further comprises a turnup edge extending outwards from an upper end of the main body, the turnup edge is provided with a third threading hole thereon, and the third threading hole is located right above the first threading hole and the second threading hole.

8. A retractable curtain comprising: the adjusting device for a curtain cord according to claim 1.

9. An adjusting device for a curtain cord, comprising: a mounting base for fixedly connecting to the lower end of a curtain body, the mounting base being provided with a first threading hole for the cord to pass through, wherein the mounting base is provided with a mounting groove thereon, and the first threading hole is provided in a groove wall of the mounting base;

the adjusting device further comprises a stopper for winding and fixing the cord, the stopper is detachably jammed within the mounting groove, and a gap for accommodating the cord wound on an outer surface of the stopper is located between the groove wall of the mounting groove and the stopper; and a winding hole is provided throughout in the middle of the stopper for the cord to pass through, the outer surface of the stopper comprises an inner surface and an outer surface which are opposite, and a side surface between the inner surface and the outer surface, the inner surface is located at an end of the stopper near a bottom wall of the mounting groove, and the center line of the winding hole and the center line of the mounting groove are parallel to each other or coincide with each other, wherein a hole wall of the winding hole is provided with one or more line slots running through the hole wall from the inner surface to the outer surface.

10. The adjusting device for a curtain cord according to claim 9, wherein the outer surface is provided with one or more line slots running through the outer surface from a hole wall of the winding hole to the side surface.

11. The adjusting device for a curtain cord according to claim 9, wherein the outer surface is provided with one or more line slots running through the outer surface from a hole wall of the winding hole to the side surface, the hole wall of the winding hole is provided with one or more line slots running through the hole wall from the inner surface to the outer surface, and the line slots on the hole wall of the winding hole correspond to the line slots on the outer surface, and are connected with corresponding line slots on the outer surface.

12. The adjusting device for a curtain cord according to claim 9, wherein the first threading hole is disposed right opposite to the winding hole, and the center line of the first threading hole coincides with the center line of the mounting groove.

13. The adjusting device for a curtain cord according to claim 9, wherein the mounting base comprises a sheet-shaped main body and a circle of protruding edges extending outwards from a lower end of the main body, the protruding edges and the main body between the protruding edges form the mounting groove, and the main body is provided with the first threading hole and a second threading hole located right above the first threading hole.

14. The adjusting device for a curtain cord according to claim 13, wherein the mounting base further comprises a turnup edge extending outwards from an upper end of the main body, the turnup edge is provided with a third threading hole thereon, and the third threading hole is located right above the first threading hole and the second threading hole.

15. A retractable curtain comprising: the adjusting device for a curtain cord according to claim 9.

16. An adjusting device for a curtain cord, comprising: a mounting base for fixedly connecting to the lower end of a curtain body, the mounting base being provided with a first threading hole for the cord to pass through, wherein the mounting base is provided with a mounting groove thereon, and the first threading hole is provided in a groove wall of the mounting base;

the adjusting device further comprises a stopper for winding and fixing the cord, the stopper is detachably jammed within the mounting groove, and a gap for accommodating the cord wound on an outer surface of the stopper is located between the groove wall of the mounting groove and the stopper; and a winding hole is provided throughout in the middle of the stopper for the cord to pass through, the outer surface of the stopper comprises an inner surface and an outer surface which are opposite, and a side surface between the inner surface and the outer surface, the inner surface is located at an end of the stopper near a bottom wall of the mounting groove, and the center line of the winding hole and the center line of the mounting groove are parallel to each other or coincide with each other, wherein the outer surface is provided with one or more line slots running through the outer surface from a hole wall of the winding hole to the side surface, the hole wall of the winding hole is provided with one or more line slots running through the hole wall from the inner surface to the outer surface, and the line slots on the hole wall of the winding hole correspond to the line slots on the outer surface, and are connected with corresponding line slots on the outer surface.

17. The adjusting device for a curtain cord according to claim 16, wherein the outer surface is provided with one or more line slots running through the outer surface from a hole wall of the winding hole to the side surface.

18. The adjusting device for a curtain cord according to claim 16, wherein the first threading hole is disposed right opposite to the winding hole, and the center line of the first threading hole coincides with the center line of the mounting groove.

19. The adjusting device for a curtain cord according to claim 16, wherein the mounting base comprises a sheet-shaped main body and a circle of protruding edges extending outwards from a lower end of the main body, the protruding edges and the main body between the protruding edges form the mounting groove, and the main body is provided with the first threading hole and a second threading hole located right above the first threading hole.

20. The adjusting device for a curtain cord according to claim 19, wherein the mounting base further comprises a turnup edge extending outwards from an upper end of the main body, the turnup edge is provided with a third threading hole thereon, and the third threading hole is located right above the first threading hole and the second threading hole.

21. A retractable curtain comprising: the adjusting device for a curtain cord according to claim 16.

* * * * *